US005277044A

United States Patent [19]

Samyn

[11] Patent Number: 5,277,044

[45] Date of Patent: Jan. 11, 1994

[54] WIRE DRAWING MACHINE WITH DIAMETER WATCHING-SYSTEM

[75] Inventor: Johan Samyn, Roeselare, Belgium

[73] Assignee: N.V. Bekaert S.A., Zwevegem, Belgium

[21] Appl. No.: 911,627

[22] Filed: Jul. 10, 1992

[30] Foreign Application Priority Data

Jul. 22, 1991 [EP] European Pat. Off. ..... 9120916.3

[51] Int. Cl.[5] ..... B21C 1/02

[52] U.S. Cl. ..... 72/6; 72/274; 72/279; 72/289

[58] Field of Search ..... 72/279, 288, 289, 280, 72/274, 6

[56] References Cited

U.S. PATENT DOCUMENTS 4,079,609 3/1978 Hodgskiss ..... 72/6

4,662,203 5/1987 Kanatani ..... 72/279

FOREIGN PATENT DOCUMENTS 53817 5/1981 Japan ..... 722/279

OTHER PUBLICATIONS

Soviet Inventions Illustrated, SU 933,155, Week 15, May 25, 1983.

*Primary Examiner*—Daniel C. Crane

*Attorney, Agent, or Firm*—Foley & Lardner

[57] ABSTRACT

A wire drawing machine having a watching system of the wire diameter at one or more watched locations in the machine. The diameter is measured by measuring the wire speed as compared to the reference wire speed at a reference location where the diameter is accurately known and held in a register. This value, together with both speed values, are sent to a computer module for calculating the wire diameter and sending this to the computer output. When a new wire enters in the drawing machine, the operation is temporarily inversed that is the lastly computed diameter is temporarily taken as the reference diameter and stored in the register, and from there the new reference diameter at the entrance is calculated and entered in the register.

12 Claims, 1 Drawing Sheet

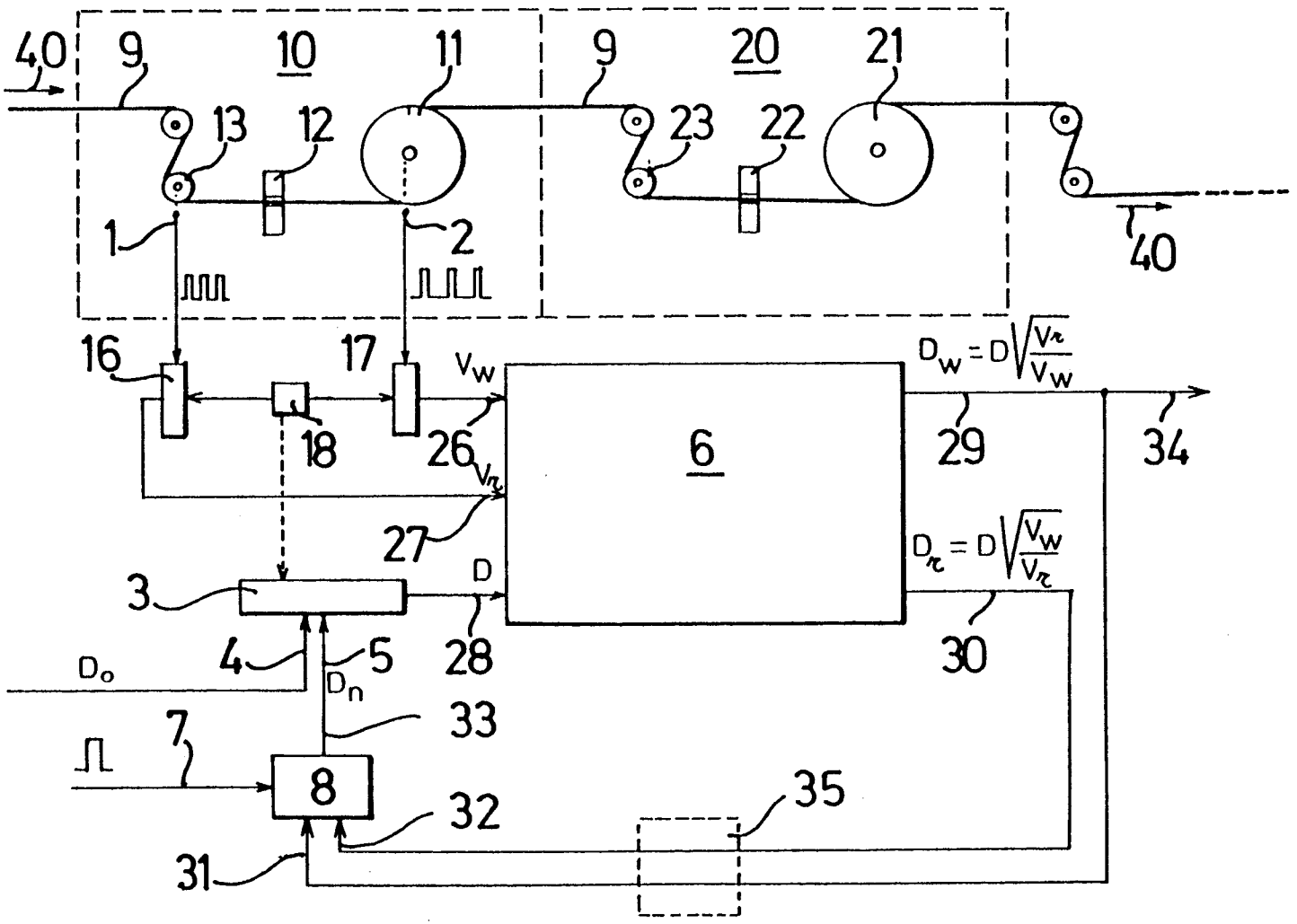
40
34
$D_W = D\sqrt{\frac{V_r}{V_W}}$
$D_r = D\sqrt{\frac{V_W}{V_r}}$
29
30
21
20
22
23
9
6
35
11
2
$V_W$
26
$V_r$
27
D
28
33
32
17
18
5
$D_n$
8
10
12
13
4
3
7
31
9
1
16
$D_o$
40

WIRE DRAWING MACHINE WITH DIAMETER WATCHING-SYSTEM

BACKGROUND OF THE INVENTION

1. Field of the Invention

The invention relates to a wire drawing machine having a watching system of the wire diameter at a watched location.

2. Description of the Related Art

A wire drawing machine comprises a number of passes, from one to ten or even more, the one downstream after the other, and in each pass the wire diameter is reduced. In order to watch over the good operation of the machine, it is desirable to watch the diameter at one or more specific locations, e.g. at the exit of one or more of the passes. Due to the wear of the drawing-die indeed, the wire diameter at the exit of such pass becomes greater and greater, and after a certain time, when the diameter exceeds the tolerance limit, the die has to be replaced. It is however not easy to continuously measure the diameter of a wire traveling at a speed of 2 to 12 m/sec, because mechanical systems are disturbed by the movement of the wire and optical systems are disturbed by dust or other pollution, or are very expensive. For that reason, in practice, the operator of the machine simply measures the wire manually when the machine is stopped for whatever reason, and when the diameter appears to have somewhat approached the limit, he replaces the drawing-die as a precautionary measure. In this way, die consumption is higher than it should be. That is, if the operator were able to continuously watch the wire diameter during the operation of the machine, he would only replace the die when it is really necessary.

Although the need of watching the wire diameter at the exit of a drawing pass has been explained hereabove, and although the explanations hereinafter will refer to watching the diameter at the exit of the drawing pass, it is clear that the invention is not limited to a watched location at the exit side of a drawing pass, but can also be usable at an entrance side thereof.

SUMMARY OF THE INVENTION

It is an object of the present invention to provide a watching system of the wire diameter at a watched location, which allows to continuous monitoring of the evolution of the wire diameter, without the need of an instrument that measures the diameter in a direct way by optical or mechanical or other means, and which is adapted to operate without human intervention during long periods, i.e. periods in which different wire coils are entered and treated in the machine, and with high accuracy.

A first step towards meeting the above object consists of the choice of the indirect method of measuring the diameter: via measuring wire speeds. In this method, the wire speed is measured, on one hand at the watched location, and on the other hand at a reference location where the diameter value is known and can be supposed to be nearly constant. As the passing steel volume per unit of time is the same at both locations, one has:

$$\pi \frac{D_w^2}{4} \times V_w = \pi \frac{D_r^2}{4} \times V_r \quad (1)$$

or

-continued $$D_w = D_r \sqrt{\frac{V_r}{V_w}}$$

in which $V_w$ and $V_r$ are the speed at the watched and reference location respectively and $D_w$ and $D_r$ the wire diameter at the watched and reference location, respectively. As $D_r$ is considered to be a fixed value, the diameter $D_w$ can continuously be calculated and a signal generated, representing such value, without direct measurement of any wire diameter.

For continuous measurement, measuring the wire speed is much easier indeed than measuring the wire diameter, e.g. by passing the wire over a slip-free pulley of which the rotation speed is measured. A condition for the operability of this method is the presence somewhere of a location where the diameter can be supposed to be nearly constant. In wire drawing, this may present a difficulty because, due to wear of the drawing dies, the wire diameter fluctuates everywhere. The entrance of the machine can however in general be used as a reference location. It has been observed indeed that the coils that are unreeled and entered into the machine, come themselves from other processes with narrow diameter tolerances at the output, and that they have a wire diameter that varies very slightly over a single coil (but can remarkably vary from coil to coil, because of different origins). Consequently, the method can be operable, at least for the period of treatment of a single coil. Another reference location can be the exit of a drawing pass with a very small diameter reduction in a strongly wear resistant die, where the method can be operable, at least for the period between two replacements of such die. In principle, any location can be chosen where the diameter remains, or is made to remain constant during a certain period. The method must however serve for a longer duration of several such periods, and in a way that human intervention can be avoided. The way how the method will bridge the transition from one period to the other, constitutes the second step towards the sclution, as explained later.

In using the method during the first period, the initial diameter $D_{o,r}$ at the reference location at standstill before starting the machine is known (e.g. by manual measurement of the diameter, or by knowledge of the opening diameter of the drawing-die just before the reference location). This diameter is preset as a fixed value $D_{o,r}$ in a register. With the use of such reference value in said register and the continuous measurement value signals of the speeds $V_w$ and $V_r$, a continuously varying value signal $D_{o,w}$ can be computed and generated according to formula (1):

$$D_{o,w} = D_{o,r} \sqrt{\frac{V_r}{V_w}} \quad (2)$$

in which $D_{o,w}$ represents the wire diameter at the watched location during said first period, i.e. the period before the first substantial change of the actual wire diameter at the reference location.

The next problem with this method is that it is only good for each single "quiet" period in which the wire diameter at the reference location does not remarkably vary. But between these quiet periods, there are transition periods of substantial change of the wire diameter, e.g. when a coil at the entrance is finished and followed by another coil (e.g. without machine stop, the tail of the former one being welded to the head of the latter), or when the reference drawing-die, just upstream of the reference location, is replaced. Then a new quiet period starts with a new reference value $D_{l,r}$ that has to be introduced in the register in replacement of $D_{o,r}$. And the problem is, how to do this, without any human intervention (measurement of diameter and introduction in the register).

The second step towards the solution consists of inverting, during the transition period, the roles of the reference location and the watched location. During the transition period, in which the diameter at the reference location is unreliable, and which period is relatively short, it is now supposed that the location where the diameter remains relatively constant, is now the watched location. One is allowed to suppose this, because this transition period is sufficiently short for neglecting die-wear or other influences.

As a consequence, the system proceeds to the inverted operation. It is now the last obtained value $D_{o,w}$ for the watched position during the first quiet period that is stored as a fixed value in the register. And it is now the diameter value $D_{l,r}$ for the reference location that is now continuously generated by means of the inverse formula:

$$D_{1,r} = D_{o,w}\sqrt{\frac{V_w}{V_r}} \tag{3}$$

When the transition period is finished, the system is made to switch over from such inverse mode back to its direct mode. This means: the last obtained value $D_{l,r}$ during the transition period is now stored as a fixed value in the register, and it is now again the diameter at the watched location, but now after the first transition period ($D_{l,w}$), that is generated by means of the direct formula (1):

$$D_{1,w} = D_{1,r}\sqrt{\frac{V_r}{V_w}}$$

As soon as a following transition period is announced, the system is made to switch over again from direct mode to inverse mode, in order to continuously generate a signal $$D_{2,r} = D_{1,w}\sqrt{\frac{V_w}{V_r}}$$

and to return then back to direct mode, in order to generate the signal $$D_{2,w} = D_{2,r}\sqrt{\frac{V_r}{V_w}}$$

in which $D_{2,w}$ is now the value, representative of the wire diameter at the watched location after the second transition.

This can so be repeated for n transitions, and each time the system switches over from direct mode to inverse mode and back.

The process can be started, either in direct mode or in inverse mode and also. E.g., when the watched location is just downstream from a drawing pass with a new drawing-die of which the opening diameter is accurately known, it is preferred to start the operation in the inverse mode, and to have the diameter at the reference location be calculated first by the system, and then to switch over to the direct mode where this calculated value is then firstly introduced into the register.

In both ways of starting, the method of measuring the diameter of the wire at the watched location consequently comprises, according to the invention (indexes a and b hereafter being equal to r and w respectively, when starting in direct mode, and equal to w and r respectively, when starting in reverse mode):

(a) providing measuring means (1) (2) of the wire speed $V_r$ and $V_w$ at said watched location, and at a reference location respectively;

(b) introducing a preset value signal $D_{o,a}$ representative of the initial value of the wire diameter at one of said locations, in a register means (3);

(c) continuously generating a value signal $D_{o,b}$, representative of the value $$D_{o,a}\sqrt{\frac{V_a}{V_b}}$$

in which $V_a$ and $V_b$ is the wire speed at said one location, respectively the other location;

(d) before a substantial change of the actual wire diameter at said one side, storing a value in said register means, representative of said value signal $D_{o,b}$;

(e) subsequently, continuously generating a signal $D_{l,a}$, representative of the value $$D_{o,b}\sqrt{\frac{V_b}{V_a}}$$

(f) before a substantial change of the actual wire diameter at said other side, storing a value in said register means, representative of said value signal $D_{o,b}$;

(g) repeating steps (c) to (f) in which $D_{o,a}$, $D_{o,b}$ and $D_{1,a}$ are replaced by $D_{n,a}$, $D_{n,b}$ and $D_{n+1,a}$, in which, for each repetition, n is the number of times the steps (c) to (f) have already been taken.

Besides the method, the invention provides a drawing machine with a watching system of the diameter at a watched location, and which comprises, according to the invention:

(a) measuring means (1) (2) of the wire speed $V_r$ and $V_w$ at a reference location and, at said watched location respectively;

(b) register means (3) for storing a value D and comprising means (4) for presetting said register means to an initial value $D_o$, and further comprising a feedback signal entrance (5) for setting said register means (3), on receipt of a feedback value signal, to such feedback value $D_n$;

(c) calculating means (6) adapted for continuously generating at its output (29) (30) a value signal $$D_w = D\sqrt{\frac{V_r}{V_w}}$$

on one hand and $$D_r = D\sqrt{\frac{V_w}{V_r}}$$

on the other hand;

(d) a feedback control switch (8) having input means (7) for a switch signal, and input means (31) (32), connected to the output (29) (30) of said calculating means, and further having an output (33) connected to said feedback signal entrance (5) of said register means (3), the switch (8) being arranged for alternately sending, on receipt of a switch signal, one of said value signals present at said input means (31) (32) towards its output (33); and (e) output means (34) connected to the output (29) of said calculating means (6).

The watching system provides a wide range of possible uses in a wire drawing machine, as shown hereafter. But, above this, the system also appears, rather unexpectedly, to perform with a reaction speed to diameter variations and with an accuracy, comparable to any optical system at least.

BRIEF DESCRIPTION OF THE DRAWINGS

The invention will now further be explained with reference to the appended drawing, showing a schematic view of the wire drawing machine with its watching system.

DETAILED DESCRIPTION OF THE PREFERRED EMBODIMENT

In this drawing, the numbers 10 and 20 refer to the first and the second pass of a wire drawing machine. Each pass comprises respectively a drawing capstan 11, 21, that respectively draws the wire 9 through a drawing-die 12, 22. Upstream of the drawing-die 12, there is a guiding pulley system with a pulley 13, 23, driven by the wire 9 into rotation in a slip-free manner. The rotational speed of this pulley is consequently proportional to the linear speed of the wire upon entering the corresponding drawing-die. In this example, the drawing-capstan is of the slip-free type, so that in this case the rotational speed of this capstan is proportional to the linear speed of the wire on the exit side of the drawing-die.

The wire travels in the direction of arrows 40, and comes from an unwinding station (not shown), where the wire is unreeled from a coil. The tail end of the wire of this coil is welded to the leading end of a next coil, so that, without stopping the wire drawing machine, the system can automatically proceed to a coil change where the next coil takes the place of the empty coil in the unwinding station. The triggering signal for coil change can be given by any mechanical, electrical or optical system for detecting that the treated coil is empty or nearly empty.

The example of FIG. 1 shows a system for measuring the wire diameter at the exit of the drawing die 12 of the first pass. This exit is consequently to be considered as the "watched location", as referred to hereinbefore. The reference location is here the entrance of the drawing-die 12, i.e. the location of pulley 13. This pulley and the driving capstan are each provided with an instrument for measuring the rotational speed, in this case, a pulse generator 1, and 2, respectively delivering electrical pulses at a rate proportional to the rotational speed, generated by well-known optical, magnetic or electrical means. Each of said pulse generators sends its pulses towards a pulse counter 16, and 17, respectively both of which are associated with a clock pulse generator 18, of which each odd output pulse resets the counters 16 and 17 to zero and each even output pulse stops the counting operation. In this way, the value stored in the counters between an even pulse and the next odd pulse, is proportional to the linear speeds of the wire, on one hand $V_w$ at the watched location, in this case the exit side of the drawing-die 12, and on the other hand $V_r$ at the reference location, in this case the entrance side of the same drawing-die. The outputs of both counters 16 and 17 are connected to the entrances, 26 and 27 respectively, of a calculator module 6, and transmits the content of the counter towards the calculator once just after each even clock pulse. These transmitted signals are digital coded signals, representing the content of the counters and consequently representing the linear speed values $V_r$ and $V_w$.

The system further comprises a digital register 3, capable of storing a value D, representative of the diameter of the wire, and comprising an input 4 where a digital coded value signal $D_o$ can be entered for presetting said register to an entered value. The output 28 of this register is connected to the entrance of said calculator module 6, and transmits the content D of the register towards the calculator module 6 at regular time intervals (e.g. at each even output pulse of said clock pulse generator 18). This transmitted signal is also a digital coded signal, representing the content D of the register or the value of the wire diameter, as lastly entered in the register.

The calculator module 6 is arranged to generate at its outputs 29, and 30 respectively, and with the use of the value signals $V_w$, $V_r$ and D, received at its input, two other digital value signals, representing the values $$D_w = D\sqrt{\frac{V_r}{V_w}}$$

on one hand and $$D_r = D\sqrt{\frac{V_w}{V_r}}$$

on the other. Both outputs 29 and 30 of the calculator module 6 are connected to the inputs 31 and 32 of a feedback switch 8, of which the output 33 is connected to another input 5 of said register 3, for resetting said register to a feed back value $D_n$, entered via input 5.

Feedback control switch 8 has three entrances: one switch pulse input 7, and two value signal inputs 31 and 32. Input 31 is connected to output 29 of the calculator 6 and receives the value signal $$D_w = D\sqrt{\frac{V_r}{V_w}}$$

and input 32 is connected to output 30 of the calculator module 6 and receives the value signal $$D_r = D\sqrt{\frac{V_w}{V_r}}$$

The switch has three positions: one "start-direct-mode-position", and one "start-reverse-mode-position" in which it transmits the signal on input 32, respectively 31, towards the output 33 and to the register 3, and one "neutral" position in which it does not allow any signal at all towards the register 3. The switch stands in general in neutral position. On receipt of a switch pulse, it comes for a very short pulse time in one of both mode positions (direct or reverse) and then comes back to its neutral position, and on receipt of the following switch pulse it comes for a same very short pulse time in the other mode position. This means, that on receiving consecutive switch pulses at input 7, the switch sends alternately the momentaneous values at inputs 31 and 32 towards the register 3.

The output 29 of calculator module 6 is connected to the output 34 of the system. The output value signal can there be either visualized on a screen, or printed out or used in any other way for controlling the wire drawing machine and/or informing the operator.

In operation, the system works as follows. At standstill, the operator measures manually the wire diameter at the entrance 9 of the machine and introduces this value $D_{o,r}$ into the register. This can be done, in dependence of the type of input means provided by the register, by means of manually setting a series of knobs to the digital value to introduce, or by a computer keyboard.

Then the machine is started and at each even output pulse of clock pulse generator 8, e.g. each half second the momentaneous values of $V_w$, $V_r$ and $D_o$ are sent to the digital calculator 6. The system works now in direct mode, i.e. the calculator 6 immediately calculates $$D_{o,w} = D_{o,r}\sqrt{\frac{V_r}{V_w}}$$

and sends this value, in the form of a coded value signal, via its output 29 towards the output 34 of the system. In dependence of the type of output means, this can be an optical display system on an operator's desk, or a computer screen, or any further data processing system, using the output signal for further processing into other information signals, e.g. "replace drawing-die".

After a certain time of operation, the unreeled coil becomes empty, and, without machine stop, the unwinding station produces a triggering signal for operating coil change, before the leading end of the wire, coming from the next coil, enters the machine. This triggering signal is transformed into two switch pulses, to send to the input 7 of feedback control switch 8. The first pulse is produced on occurrence of the triggering signal, and the other pulse, using an appropriate time delay circuit, about 20 seconds thereafter, when the heading end of the next coil has already passed the wire drawing machine. The first pulse will serve for setting the system in the reverse mode, and the second pulse for resetting in the direct mode.

On arrival of the first switch pulse at the feedback control switch 8, the signal at input 31 of the switch 8 is transferred to the output 33 for a short while, sufficient to pass the value signal $D_{o,w}$, coming from the output 29 of the calculator module 6, and to enter the value, represented by this signal, via input 5, into register 3, replacing the former value $D_{o,r}$. At this time, the system works in the reverse mode, i.e. the calculator 6 immediately calculates $$D_{1,r} = D_{o,w}\sqrt{\frac{V_w}{V_r}}$$

and sends this value, in the form of a coded value signal, via its output 30 towards the input 32 of feedback control switch 8, that stands in neutral position and does not transfer this signal towards register 3. During this reverse mode, the output 29 of the calculator 6 is of no use, because it calculates a value $$D_{o,w}\sqrt{\frac{V_r}{V_w}}$$

that does not correspond to the diameter at the watched position. For that reason, during this reverse mode, the output 34 is frozen by electronic means (not shown) to the last calculated value during the direct mode.

On arrival of the second switch pulse at the feedback control switch 8, the signal at the input 32 of the switch 8 is transferred to the output 33, sufficient to pass the value $D_{l,r}$, coming from the output 30 of the calculator module 6, and to enter this value into register 3, in replacement of the former value $D_{o,w}$. The system now again works in direct mode, i.e. that the calculator sends to the output 34 the value signal $$D_{1,w} = D_{1,r}\sqrt{\frac{V_r}{V_w}}$$

that corresponds to the wire diameter at the watched location.

This short position in reverse mode is operated at each next coil change.

The system can also be used at the start in the reverse mode, when the operator accurately knows the opening diameter of drawing-die 12 at the start of the machine operation. Then, he does not need to manually measure the wire diameter of the first coil before the machine starts. He lets the system itself calculate this value, by starting the machine in the reverse mode. Before the machine starts, he enters into register 3 the value $D_{o,w}$ of the wire at the watched position (equal to the drawing-die opening), and at the start of the machine, he triggers the switch pulses for the feedback control switch 8. In this way, the system starts in the reverse mode, and output 30 delivers the diameter value $D_{r,1}$ at the entrance. When the second switch pulse arrives, this value is entered in register 3 and the system can start watching the diameter at the watched position via output 34.

It is clear that many different forms of execution of the same system can be designed without deviating from the essence of the invention.

In the first place: the signals that are transmitted forward towards the output, or in feedback, are "value signals". This means that they contain the information of a value, that can be derived therefrom with an adapted decoding system. Such signals can be of the analog type, e.g. voltages of which the value corresponds to the value to represent. They can also, as preferred for reasons of accuracy, be of the digital type, in the form of coded pulses, transferred in series or in parallel at regular time intervals. The measuring means 1,2, the register 3 and calculator 6 have then to be adapted for such signals: a tachymeter for speed measuring, condensator means for memorizing analog values, and digital memory means for registering digital values, and analog calculators, digital calculating means respectively for calculator 6. These value signals are "representative of the value" of a magnitude, but this does not mean that the value, contained in the signal, must be equal to or directly proportional to the value it has to represent. Then however, the calculator 6 shall have to take this into consideration. For instance: the value signal, stored in the register can be a coded value, not of D, but of $D^2$, and the value signal at the output 29 can be a coded value, not of $$D\sqrt{\frac{V_r}{V_w}}$$

but of $$D^2 \times \frac{V_r}{W_r}$$

but these are still value signals "representative of" the value they have to represent. The value decoder 34 shall have to be adapted thereto, and also the calculator 6, which has then not to calculate any square roots, but only to multiply the value entered at input 28 with the proportion of the values, entered at inputs 26 and 27.

Without deviating from the essence of the invention, one can also use other wire speed measuring means other than those that give at their output a value signal that is equal to, proportional to, or representative of the measured speed. After all, the calculator is only interested in the proportion $$\frac{V_w}{V_r}$$

and the inversed proportion $$\frac{V_r}{V_w}$$

and any measuring means allowing the delivery of a value, representative of such proportion, is usable, without having to pass through the values $V_w$ and $V_r$ themselves. For instance: pulse generator 1 can be used to open a switch for e.g. 1000 pulses and then close it again, whilst during the opening time the pulses coming from generator 2 are allowed to pass to to a counter. The value, stored in the counter when the switch closes again, corresponds then to $$\frac{V_w}{V_r}$$

The calculator 6 has to be adapted for "continuously" generating at its outputs (29) (30) the said values $D_w$ and $D_r$. This does not mean that the calculator must deliver a mathematically continuous signal, but this can also be a train of signal pulse combinations, in which each combination represents said values, and in which the combinations follow each other at sufficiently short intervals for being representative of the momentaneous values they represent. Further, during the inverse mode, the signal $D_w$ at output 29, is of no use, so that generation of this signal can be interrupted in the inverse mode. And the same applies to the signal $D_r$ at output 30 in the direct mode. The calculator can be conceived to have only one output instead of outputs 29 and 30, and only calculating and generating $D_w$ during the direct mode and $D_r$ during the inverse mode.

The output of the calculator is connected to the input of the feedback switch in order to operate the feedback of the values $D_w$ and $D_r$ towards the register 3. This does not mean that this feedback connection would be a direct connection, without any possible treatment of the values $D_w$ or $D_r$ between the outputs 29, 30 and the entrance of control feedback switch 8. It is more specifically desirable that the output of the calculator 6 passes through a data processor 35 (in dotted lines in the figure) making the average of the values $D_w$ and $D_r$ over the last few seconds. In such case, the system is protected against a feedback towards switch 3 of a momentaneous value just at a moment when there is some anomaly in the measured speed. Consequently, the generation or transmittal of value signals "representative" of certain values also means, in a broad sense: representative of the average of such value.

In dependence on the practical realization of the system, it may also be necessary to insert a time delay element in the system. The system must not operate so rapidly that, when a switch pulse occurs at the input 7 of switch 8, in order to admit a feedback signal into register 3, that the calculator already would have generated the new value at its output and sent it back to register 3 before the switch closes again. If necessary, this time delay system can be inserted either in the direct part or the feedback part of the loop, formed by elements 3, 6 and 8.

It is further clear that the preferred and most attractive way of realization of this invention is by way of a computer, programmed to store in its memory the values that have to be stored, to calculate in its processor the values that have to be calculated, and to transfer the values at the right times under control of the computer programme.

More specifically, the register 3 must not necessarily be a hardware element. The register function can be executed in a computer memory module, where the value to store is stored at a given address, where the programme knows where to find it, and where the next value is stored at the same, or at another address, where the programme still knows where to find it.

Similarly: the calculator 6 must not necessarily be a calculator module, specially designed only to calculate the mentioned formulae. The calculating function can also be executed in a digital processor module, adapted for any sort of calculation or data processing, but that has been programmed to send the desired data at the desired moment towards the desired output or memory address. The same applies to the memory switch, and to any necessary calculator of average values.

This all means that the whole of registering, calculating and switching functions can be performed in a programmed manner in a digital computer. The diameter data at the watched location can then also further be processed, in the same computer, with other data towards a number of messages for the operator on the computer screen or on other warming apparatuses, or towards the command input of any automatically controlled part of the drawing machine.

The wire-drawing machine will in general comprise a number of watched locations, with each a watching system, e.g. a watching location at the exit of each drawing pass. These watching systems may all use the same reference location, at the entrance 9 of the first pass, or they may not. The watched locations are then "directly" downstream from each drawing die: this means without any further diameter reduction between the drawing-die and the watched location where the wire speed is measured. It is not because, by wear, the opening of a drawing-die in an intermediate pass exceeds a limit, that this die has directly to be replaced. This may depend on the other diameters, and the message for the operator may result from processing the different obtained data in the computer.

I claim:

1. A wire drawing machine having a watching system for watching a wire diameter at a watched location, said watching system comprising:

(a) measuring means, having an output (1) (2) for measuring wire speeds $V_r$ and $V_w$ at a reference location and at said watched location, respectively;

(b) register means (3), having an output (28) which transmits a signal that is representative of a value of a content of said register means, means (4) for presetting said register means (3), and a feedback signal entrance (5) which receives a feedback signal that is representative of a new value and which sets said register means (3), on receipt of the feedback signal at said signal entrance, to the new value;

(c) calculating means (6), having an input (26) (27) (28) and an output (29) (30) in which the calculating means input is connected to the output of said measuring means and the output of said register means, for continuously generating at its output (29(30) first and second value signals $$D_w = D\sqrt{\frac{V_r}{V_w}}$$

and $$D_r = D\sqrt{\frac{V_w}{V_r}},$$

respectively, in which D is the value of the content of said register means;

(d) a feedback control switch (8) having input means (7) for receiving a switch signal, input means (31) (32), connected to the output (29) (30) of said calculating means for receiving an input therefrom, and an output (33) connected to said feedback signal entrance (5) of said register means (3), the switch (8) being arranged for alternately sending, on receipt of the switch signal, one of said first and second value signals present at said input means (31) (32) towards its output (33); and (e) output means (34), connected to the output (29) of said calculating means (6), for producing a signal indicative of the wire diameter at the watched location.

2. A wire drawing machine according to claim 1, in which said measuring means is arranged to deliver at its output a digital value, representative of the measured wire speeds.

3. A wire drawing machine according to claim 1, in which said register means (3) is a digital memory programmed for storing subsequent entering values at programmed addresses in said digital memory.

4. A wire drawing machine according to claim 1, in which said calculating means (6) is a digital processor programmed for generating instantaneous digital values of $D_w$ and $D_r$ at regular time intervals.

5. A wire drawing machine according to claim 1, in which said input means (31) (32) of said feedback control switch connected to the output of said calculating means comprise calculating means for calculating the average of each of the first and second value signals received from the output (30) (29) of the calculating means (6).

6. A wire drawing machine according to claim 1, in which said register means (3), said calculating means (6) and said feedback control switch (8) are a programmed digital computer.

7. A wire drawing machine according to claim 1, in which said reference location is the entrance of said machine.

8. In the operation of a wire drawing machine, the method of watching the diameter of a wire at a watched location, said method comprising:

(a) providing measuring means (1) (2) for measuring wire speeds $V_r$ and $V_w$ at a reference location and at said watched location, respectively;

(b) introducing a preset value signal $D_{o,a}$, representative of an initial value of the wire diameter at one of said reference and watched locations, into a register (3), and starting the wire drawing machine;

(c) continuously generating a value signal $D_{o,b}$, representative of the value $$D_{o,a}\sqrt{\frac{V_a}{V_b}}$$

in which $V_a$ and $V_b$ are the respective measured wire speeds at said one of said reference and watched locations and at the other of said reference and watched locations, respectively;

(d) before a substantial change of in actual wire diameter at said one of said reference and watched locations occurs, storing a value in said register means representative of said value signal $D_{o,b}$;

(e) subsequently, continuously generating a value signal $D_{l,a}$, representative of the value $$D_{o,b}\sqrt{\frac{V_b}{V_a}}$$

(f) before a substantial change of an actual wire diameter at said other of said reference and watched locations occurs, storing a value in said register representative of said value $D_{l,a}$;

(g) repeating the cycle of steps (c) to (f) a number of times, in which $D_{o,a}$, $D_{o,b}$ and $D_{l,a}$ are replaced by $D_{n,a}$, $D_{n,b}$ and $D_{n+l,a}$, in which, for each cycle, n is the number of cycles already completed; and (h) displaying symbols indicative of the value signals generated in steps (c) and (e) to monitor the diameter of the wire at the watched location.

9. A method according to claim 8, in which said one of said reference and watched locations is the reference location located at an entrance of the wire drawing machine and said other of said reference and watched locations is the watched location located directly downstream from a drawing die of said wire drawing machine, and in which the storing operations of steps (d) and (f) respectively occur a few seconds before and a few seconds after each change of an entrance coil of the wire drawing machine.

10. A method according to claim 8, in which said one of said reference and watched locations is the watched location located directly downstream from a drawing-die of said wire drawing machine, and said other of said reference and watched locations is the reference location located at an entrance of the wire drawing machine, and in which the storing operation of step (d) occurs a few seconds after starting the wire drawing machine, and in which the subsequent steps (f) and (d) respectively occur a few seconds before and after each change of an entrance coil of the wire drawing machine.

11. A method as recited in claim 8, further comprising the step of collecting, during each cycle, the signal $D_{n,b}$ during step (c) when said one of said reference and watched locations is the reference location, and the signal $D_{n+l,a}$ during step (e) when said one of said reference and watched locations is the watched location, wherein n is the number of cycles already completed.

12. A wire drawing machine having a monitoring system for monitoring changes in a diameter of a wire at a first location of said drawing machine, said monitoring system comprising:

determining means for determining a first wire speed $V_w$ at said first location and a second wire speed $V_r$ at a second location of said first drawing machine and for outputting wire speed signals which are indicative of said first and second wire speeds;

a register for storing a value D which is representative of a diameter of at least one of a wire and a drawing-die opening, said register including presetting means for presetting the value D to an initial predetermined value, means for resetting said register including a feedback signal entrance which receives a feedback signal, said resetting means setting the value D to a new value based on said feedback signal, and register output means for outputting a register signal indicative of the value D;

a calculator which receives said wire speed signals and said register signal, said calculator generating a first calculator signal $D_w$ and a second calculator signal $D_r$, which are representative of a wire diameter at the first location and a wire diameter at the second location, respectively, based on said wire speed signals and said register signal, said first and second calculator signals respectively defined as follows $$D_w = D\sqrt{\frac{V_r}{V_w}}$$

$$D_r = D\sqrt{\frac{V_w}{V_r}}\ ;$$

a switch which generates a switch signal when actuated;

a feedback control switch which receives said first and second calculator signals and said switch signal and which upon receipt of said switch signal alternately sends one of said first and second calculator signals to said feedback signal entrance of said register, wherein said first and second calculator signals, upon being sent to said feedback signal entrance, are said feedback signal; and an output device which receives said first calculator signal and which displays a symbol indicative of the wire diameter at the first location based on said first calculator signal.

* * * * *